United States Patent [19]

Johanson et al.

[11] 4,045,329

[45] Aug. 30, 1977

[54] COAL HYDROGENATION WITH SELECTIVE RECYCLE OF LIQUID TO REACTOR

[75] Inventors: Edwin S. Johanson, Princeton, N.J.; Ronald H. Wolk, San Jose, Calif.

[73] Assignee: Hydrocarbon Research, Inc., Trenton, N.J.

[21] Appl. No.: 635,796

[22] Filed: Nov. 28, 1975

Related U.S. Application Data

[63] Continuation-in-part of Ser. No. 434,952, Jan. 21, 1974, abandoned, which is a continuation of Ser. No. 137,223, April 26, 1971, abandoned.

[51] Int. Cl.[2] ..... C10G 1/08

[52] U.S. Cl. ..... 208/10

[58] Field of Search ..... 208/10, 11

[56] References Cited

U.S. PATENT DOCUMENTS

| | | | |
|---|---|---|---|
| 2,987,465 | 6/1961 | Johanson | 208/10 |
| 3,519,553 | 7/1970 | Johanson et al. | 208/10 |
| 3,540,995 | 11/1970 | Wolk et al. | 208/10 |
| 3,607,719 | 9/1971 | Johnson et al. | 208/10 |
| 3,617,474 | 11/1971 | Stotler et al. | 208/10 |

*Primary Examiner*—C. Davis
*Assistant Examiner*—James W. Hellwege
*Attorney, Agent, or Firm*—Michael A. Jacobs

[57] ABSTRACT

Coal is hydrogenated in an upflow, random motion, gas-liquid-catalyst process in which the heavy liquids (800° F to 1000° F) are recycled to the reactor to optimize production of preferred 400°-800° F boiling range end product liquids.

The optimization is accomplished by not recycling to the reactor any liquid fraction boiling between about 600° and 800° F.

6 Claims, 1 Drawing Figure

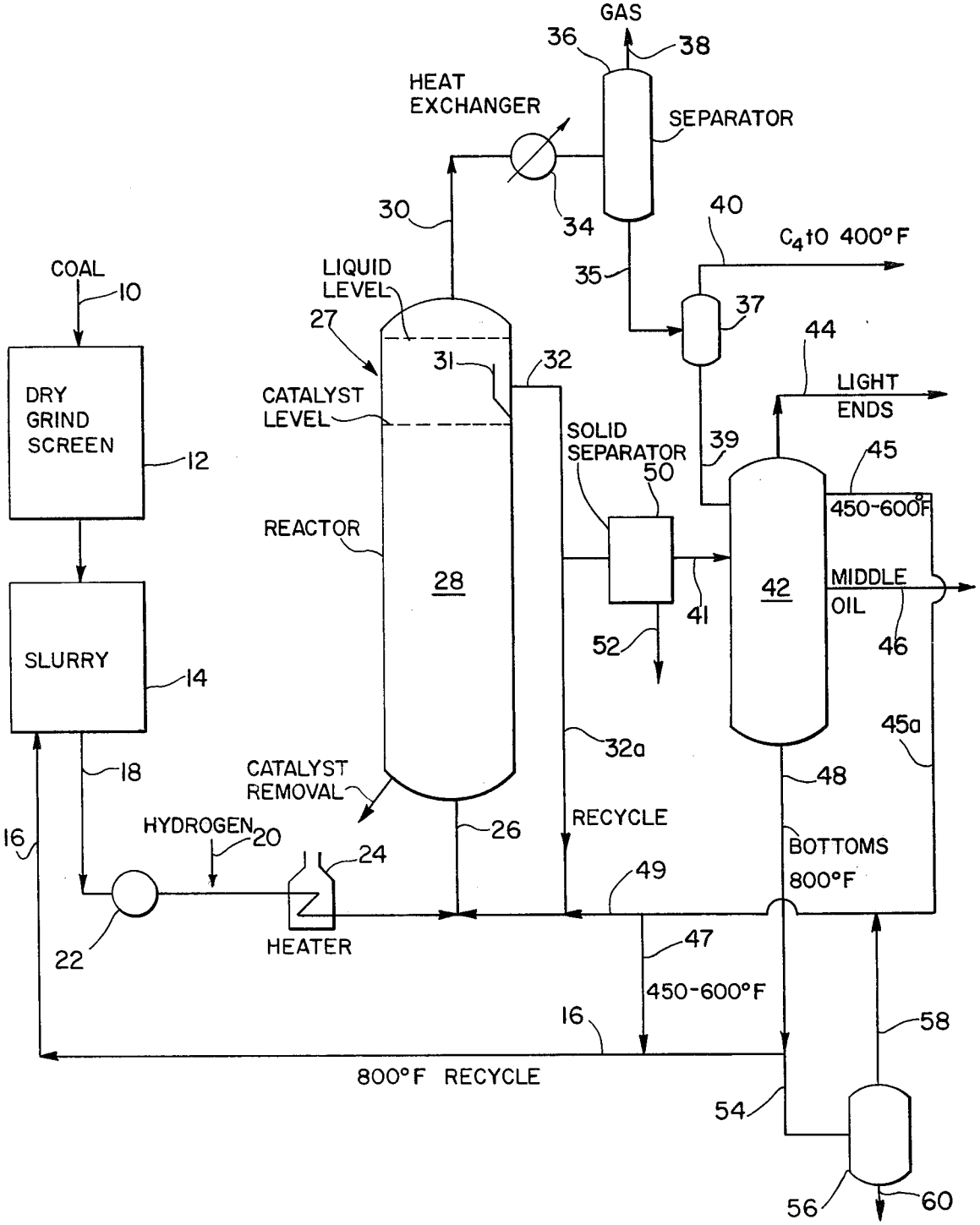
GAS
36
38
HEAT EXCHANGER
SEPARATOR
30
34
40
$C_4$ to 400°F
35
COAL
10
LIQUID LEVEL
37
27
44
31
32
LIGHT ENDS
DRY GRIND SCREEN
12
CATALYST LEVEL
SOLID SEPARATOR
39
45
50
450-600°F
REACTOR
28
42
MIDDLE OIL
41
52
46
SLURRY
14
45a
32a
18
CATALYST REMOVAL
48
16
HYDROGEN
20
26
RECYCLE
BOTTOMS 800°F
24
49
22
HEATER
47
450-600°F
16
58
800°F RECYCLE
54
56
60

COAL HYDROGENATION WITH SELECTIVE RECYCLE OF LIQUID TO REACTOR

REFERENCE TO RELATED APPLICATIONS

This is a continuation-in-part application of Ser. No. 434,952, filed Jan. 21, 1974, now abandoned which was a continuation of Ser. No. 137,223 filed Apr. 26, 1971 and now abandoned.

BACKGROUND

U.S. Pat. No. Re. 25,770 describes a gas-liquid contacting process for hydrogenating a carbonaceous material which is characterized by an upflow, liquid phase condition of controlled velocity of liquid and gas wherein particulate contact solids are placed in random motion in the liquid without substantial carryover of the solids from the reactor. By such means, it is possible to achieve nearly iso-thermal conditions even with highly exothermic reactions such as hydrogenation and thus obtain optimum contact at optimum temperature conditions. This so-called "ebullated" bed concept has been demonstrated as effective for the liquefaction of coal.

A subsequent U.S. Pat. No. 3,519,555, discloses improvements in the aforementioned patent wherein by controlled reaction zone conditions, yields of liquid of the character of synthetic crude oil can be obtained to the extent of about four barrels per ton of coal on a moisture and ash free (maf) basis.

U.S. Pat. No. 3,519,553 to Johnson et al discloses a coal conversion process utilizing a catalytic ebullated bed reactor for producing a range of vapor and liquid products, and which recycles a high concentration residuum stream to the reaction zone. However, this process also utilizes a suitable wash liquid to assist in the separation of the residuum and solids from the heavy liquids. Further, U.S. Pat. No. 3,540,995 to Wolk et al discloses a coal hydrogenation process wherein the concentrations of liquid residuum and unconverted solids in the reaction zone are maintained within desired ranges by recycling to the reactor certain heavy liquid streams from which solids have been partially removed. Although Wolk et al recycles to the reactor as slurrying oil a combination of heavy distillate and heavy vacuum still bottoms materials, he does not disclose the desirability of recycling certain selected higher liquids which have now been found highly advantageous in improving the yield of desirable 400°-800° F boiling range liquids.

SUMMARY

The present invention is more paraticularly drawn to the more critical operating conditions which have been found to permit selectively controlling the quality and quantity of the liquid products, so as to enhance the production of the more desirable liquid product streams having a normal boiling range of about 400° to 800° F. This specifically includes recycle of the 800° F plus boiling range fraction, as well as a portion of the 450°-600° F boiling range fraction to the upflow reaction zone for further processing therein. The remaining 975° F plus residue material is removed as heavy liquid product.

The reaction zone operating conditions useful for this invention are temperature in the range of 750° to 900° F, and preferably about 800° to 875° F; hydrogen partial pressure in the range of 1500 to 3000 psig, and preferably about 2000 to 2500 psig; and a feed rate of solid carbonaceous material between about 10 and 100 pounds per hour per cubic foot reactor volume, and preferably about 30 to 80 pounds per hour per cubic foot reactor volume. The contact solids in the reaction zone will usually be a particulare catalyst such as 1/32- to ⅛-inch diameter extrudates of cobalt molybdenum supported on alumina or nickel tungsten or alumina.

While this invention is generally useful for hydrogenating solid carbonaceous materials such as coal, lignite, and shale, it is preferably used for the hydrogenation of coal to produce primarily those hydrocarbon liquid products having a normal boiling temperature range of about 400° to 800° F.

DRAWING

The drawing is a schematic representation of the principal elements of a liquid phase hydrogenation process for liquefying coal.

DESCRIPTION OF PREFERRED EMBODIMENT

As disclosed in the drawing, coal introduced at 10 is usually dried, ground and screened at 12 and is preferably of a size substantially all passing 50 mesh with approximately 80 percent retained on 100 mesh (U.S. Standard) screen. This coal is then slurried at 14 with a heavy slurry oil 16 hereinafter described to provide an oil-coal ratio of from about one part of oil per part of coal to about 10 parts of oil per part of coal. While the principal purpose of this slurry oil is to produce a pumpable slurry, the oil constituents so recycled are also further treated in the reactor, so that the selection of the components of this slurry oil has an important influence on the products of the operation.

The coal-oil slurry at 18 is pumped at 22 and combined with a hydrogen-rich gas 20, and passed through heater 24 and line 26 into the hydrogenation reactor 28.

The reactor 28 is adapted for an upflow, liquid-phase operation with the coal and a particulate hydrogenation catlyst added at 27 being placed in random motion therein without substantial carryover of solids except for fines of unconverted coal and ash. A vapor stream is removed from the upper part of the reactor through line 30 above the liquid level. A liquid effluent stream containing unconverted coal and ash solids is removed from the trap tray section 31 also located near the top of the reactor and above the catalyst level through the line 32.

The vapor stream 30 is conveniently cooled in heat exchanger 34 and the gas separated from the condensate in separator 36. The gas in 38 may be purified and the resulting hydrogen repressured for use as the hydrogen-rich gas at 20, along with any fresh makeup hydrogen as needed. The condensate at 35 is flashed to lower pressure and phase separated at 37 to provide liquid stream 39 and a hydrocarbon fraction 40 having a boiling range of $C_4$'s to about 400° F.

Preferably the liquid-solid stream 32 leaving reactor 28 is first subjected to a solids separation operation at 50, such as by a filter, liquid cyclone, or centrifuge with a solids purge at 52. Alternatively, solids can be separated from bottoms fraction 48. The liquid stream 41 along with liquid stream 39 is separated in distillation or fractionation system 42 into light ends at 44, a light distillate boiling between about 450° and 600° F removed at 45, a middle oil product at 46, and a bottoms fraction removed at 48. The bottoms fraction also contains any unreacted coal and ash not removed at 52, and has a selected normal boiling range in excess of 800° F, and principally about 800° to 975° F. A major portion of the relatively solids-free heavy oil at 48 is recycled as slurry oil 16 to the system. The remaining 975° F plus material at 54 not recycled to the reactor as stream 16 is passed to a vacuum distillation at 56. Overhead liquid stream 58 is preferably added to light distillate stream 45*a* for recycle to the reactor as mentioned hereinafter and bottoms stream 60 is withdrawn as heavy product.

A portion 32*a* of the liquid effluent 32 is usually also recycled directly to the reactor. The purpose of this recycle stream 32*a* is primarily for maintaining the desired ebullation of catalyst and liquids in the reactor 28 as described in the aforementioned patents.

To avoid having undesirably viscous liquid in the reactor 28, we also utilize recycle to the reactor of a predetermined portion 45*a* of the light distillate fraction 45. Stream 45*a* is preferably fed via streams 47 and 16 into the slurry mixing chamber 14, but a portion may be fed directly into the recycle liquid stream 32*a* via stream 49.

Intensive treatment of the heavy distillate and gas oil fraction 48 boiling between about 800° and 1000° F, obtained from the catalytic hydrogenation of coal by upflow through an ebullated bed with hydrogen, is thus accomplished in the primary reactor. Due to the high aromatic and nitrogen content of this gas oil stream 48 and its consequent low reactivity relative to normal petroleum gas oils, it is necessary to operate at unexpectedly low space velocities in order to achieve the desired conversion of coal to lower boiling liquids and gases. When the aromatics and heterocyclics in stream 48 are hydrogenated in this reactor using a strong hydrogenation catalyst, the subsequent hydrocracking of the light distillate, middle oil and bottoms can be achieved much more easily. The selective recycle of the light distillate at 45*a* along with the high concentration residuum stream 48 to the reactor 28 also tends to extinguish the heavy gas oil fraction and the residuum oil fraction 48 as well by conversion to lower boiling hydrocarbons.

This heavy oil recycle arrangement is of substantial significance as the heavy gas oil produced from coal in an ebullated bed reactor is relatively unreactive and difficulty is encountered in the use of secondary processes for conversion to light distillates and naphtha. The recycle of the 800° F plus heavy gas oil fraction 48 is essential therefore in the interest of producing the desirable lighter distillates normally boiling between about 400° and 800° F.

It is well known that these lighter distillates boiling in the 400°–800° F range are readily converted with very high selectivity over 90 percent to naphtha after removal of nitrogen, sulfur, and oxygen in a simple hydrogenation step using the conventional silica-alumina catalyst promoted with a hydrogenation catalyst. The recycle of this 400°–800° F distillate material to the coal conversion reactor is disadvantageous because of the poor selectivity to naphtha production obtained there. However, the lower range of this fraction is of low reactivity in a coal conversion reactor so its recycle to the reactor for viscosity control can be tolerated.

While the heavier gas oil 48 can be similarly desulfurized, it cannot be economically hydrocracked with a silica-alumina catalyst because of excessive deactivation caused by the greater degree of condensation of the aromatic rings in the higher boiling liquids. The hydrocracking with silica alumina catalyst can be used normally because of the high selectivity and the low (4%) gas loss. Alternative conversions result in only about 75–80 percent conversion to naphtha.

The indicated selectivity of the heavy gas oil conversion to naphtha resulting from recycle of bottoms fraction to the reactor as described herein is about 72 percent but the complexity of equipment needed is so much less than for subsequent treatment means using a modified cycle, that it is greatly preferred from an economic standpoint.

Examples of operations conducted are as follows:

TABLE 1

| COAL | |
|---|---|
| Run No. | 177–35 |
| Analysis - Weight % | |
| Moisture | 1.64 |
| Proximate, Dry Basis | |
| Ash | 8.30 |
| Volatile | 42.76 |
| Fixed Carbon | 48.94 |
| Ultimate, Dry Basis | |
| Carbon | 73.81 |
| Hydrogen | 5.14 |
| Nitrogen | 1.24 |
| Sulfur | 4.00 |
| Ash | 8.30 |
| Oxygen (diff) | 7.51 |
| Sulfur Forms | |
| Pyrites | 1.47 |
| Sulfate | 0.05 |
| Organic (diff) | 2.01 |
| Heating value - B.T.U./lb. Dry | 13.491 |

TABLE 2

| REACTOR OPERATING CONDITIONS | | |
|---|---|---|
| | Preferred | Useful Range |
| Hydrogen Partial Pressure, psig | 2000–2500 | 1500–3000 |
| Temperature, °F. | 800–875 | 750–900 |
| Feed Rate lbs/hr/Ft$^3$ reactor | 15–50 | 10–100 |
| | Hydrocarbon Products - lb/100 lb Coal | |
| | Distilled Oil Recycle | Modified Recycle of Residuum |
| Gaseous $C_1$-$C_3$ | 13.1 | 13.1 |
| $C_4$-400° F | 22.8 | 22.8 |
| 400°–600° F | 19.1 | 19.1 |
| 600°–800° F | 9.8 | 15.0 |
| 800°–975° F | 5.2 | 0.0 |
| 975° + Residual Oils | 8.9 | 8.9 |
| Potential $C_4$-400° F naphtha after secondary processing of distillates | 52.6 | 53.5 |

Recycle Fractions, lb/lb

TABLE 2-continued

| REACTOR OPERATING CONDITIONS | | |
|---|---|---|
| | Coal | |
| | Base Case | For 800°-975° F Material Elimination |
| 450°-600° F | 0.05 | 0.15 |
| 600°-800° F | 0.30 | 0 |
| 800°-975° F | 0.22 | 0.50 |
| 975° F+R | 0.53 | 0.53 |
| | 1.18 | 1.18 |
| Conversion (coal disappearance) | | |
| In excess of 90% - as high as 95% (maf) | | |

It will thus be apparent that the selected recycle of the heavy gas oils to the reactor is preferable to separate, subsequent treatment of such stream. However, as indicated above, it is preferable to also recycle some of the light distillates (stream 45*a*) only for the purpose of controlling the viscosity of the liquid in the reactor. Usually such light distillates comprising from about 5 to 25 percent of the total oil recycle is appropriate and preferred. This will, of course, vary with the coal being hydrogenated.

The ultimate liquid products are thus the liquid light ends 44, light distillates 45 and middle oil 46 having an overall normal boiling range of about 600° to 800° F with a minimum production of higher boiling oils and unreacted coal.

It is recognized that many modifications of the invention heretofore described can be made without departing from the spirit and scope thereof and therefore, a broad interpretation of the claims appended hereinafter is desired.

We claim:

1. A process for producing naphtha and light hydrocarbons distillate of a boiling range of about 400° to 800° F from solid carbonaceous substances selected from the class of coal, and lignite in a particulate form, which comprises:

a. slurrying the solid carbonaceous substances with at least a portion of a heavy hydrocarbon slurry-oil recycle liquid produced in the process:

b. feeding the slurry and a hydrogen-rich gas to a reaction zone containing particulate contact solids;

c. passing the slurry and gas upwardly through the reaction zone under liquid phase conditions in which the solids are placed in random motion in the liquid, with the velocity maintained below a rate which carries any substantial portion of the contact solids out of the reaction zone, and under hydrogenation reaction conditions of hydrogen partial pressure between 1500 and 3000 psig and temperature between about 750° and 900° F;

d. removing a gaseous effluent from the reaction zone;

e. removing a liquid effluent from the reaction zone;

f. fractionating out of said liquid effluent fractions comprising at least a light distillate liquid normally boiling between about 450° and 600° F, and a bottoms fraction normally boiling in the range of about 800° to 1000° F;

g. recycling to the reaction zone said bottoms fraction and at least a portion of the 450°-600° F liquid fraction, without recycling to the reaction zone any liquid fraction boiling between about 600° and 800° F; and h. recovering from said fractionation step (f) a principal product fraction having a normal boiling range of about 400°-800° F.

2. The process of claim 1 wherein the carbonaceous solid is coal and the coal-oil slurry is prepared by using from 1 to 10 pounds of total slurrying oil per pound of coal.

3. The process of claim 2 wherein the coal feed rate to the reaction zone is between about 15 and 100 pounds cool per hour per cubic foot reactor volume and a naphtha product normally boiling at up to about 400° F is recovered from reaction zone gaseous effluent.

4. The process of claim 1 wherein the liquid effluent from the reaction zone is subjected to solids separation before the fractionation step.

5. The process of claim 1 wherein the bottoms fraction from step (f) is partially freed of particulate solids before use as a slurry oil.

6. A process for the catalytic hydroconversion of coal and for hydrogenating hydrocarbon liquids derived from coal in the liquid phase in the presence of a mass of particulate catalytic solids nominally maintained within a contact reaction zone to produce naphtha and distillate hydrocarbon liquids having a normal boiling range of about 400° to 800° F, which comprises:

a. passing the coal solids with a heavy recycle slurry oil and a hydrogen-rich gas upwardly through the mass of catalytic solids, maintaining the reaction zone at hydrogenation conditions of elevated temperature in the range of 800°-900° F and hydrogen partial pressure between about 3000 pounds per square inch, so that at least a substantial part of the oil remains in the liquid phase;

b. maintaining upward liquid and gas velocity within the reaction zone so that the mass of catalytic solids is in a state of random motion and expanded to occupy at least 10 percent greater volume than the settled state of the mass, and maintaining in said contact zone an interface below which the mass of solids exists at a concentration greater than five pounds per cubic foot and above which said solids are at a concentration of less than 0.10 pounds per cubic foot;

c. removing a gaseous effluent stream from the reaction zone and cooling said effluent;

d. removing a liquid effluent stream containing coal solids from the reaction zone;

e. passing the solids-containing liquid effluent to a solids separation step for at least partial removal of particulate solids from the liquid;

f. fractionating the liquid effluent containing reduced solids into at least four fractions comprising a light ends fraction, a light distillate fraction normally boiling between about 450° and 600° F, a middle oil fraction normally boiling between about 600° and 800° F, and a bottom fraction normally boiling between about 800° and 975° F;

g. recycling said 800° F to 975° F bottoms fraction along with sufficient portion of the 450°-600° F distillate fraction to comprise about 5-25 percent of the bottoms fraction to the reaction zone, but without recycling any of the liquid fraction boiling between about 600° and 800° F; and h. withdrawing from the fractionation step liquid product fractions having normal boiling range of about 400°-800° F.

* * * * *